US009464765B2

(12) United States Patent
Kim et al.

(10) Patent No.: US 9,464,765 B2
(45) Date of Patent: Oct. 11, 2016

(54) LED LIGHTING APPARATUS

(71) Applicant: LUMIRICH CO., LTD., Incheon (KR)

(72) Inventors: Ha-Chul Kim, Seoul (KR); Hwa-Gune Chong, Incheon (KR)

(73) Assignee: LUMIRICH CO., LTD., Incheon (KR)

( * ) Notice: Subject to any disclaimer, the term of this patent is extended or adjusted under 35 U.S.C. 154(b) by 191 days.

(21) Appl. No.: 13/889,533

(22) Filed: May 8, 2013

(65) Prior Publication Data

US 2013/0301255 A1 Nov. 14, 2013

(30) Foreign Application Priority Data

May 8, 2012 (KR) ..... 10-2012-0048699

(51) Int. Cl.

| | |
|---|---|
| ***F21V 21/00*** | (2006.01) |
| ***F21K 99/00*** | (2016.01) |
| ***F21V 23/06*** | (2006.01) |
| *F21Y 101/02* | (2006.01) |
| *F21Y 103/00* | (2016.01) |
| *H01R 12/72* | (2011.01) |
| *H01R 13/24* | (2006.01) |

(52) U.S. Cl.

CPC ..... *F21K 9/17* (2013.01); *F21K 9/175* (2013.01); *F21V 23/06* (2013.01); *F21Y 2101/02* (2013.01); *F21Y 2103/003* (2013.01); *H01R 12/721* (2013.01); *H01R 13/2442* (2013.01)

(58) Field of Classification Search

CPC ..... F21K 9/17; F21K 9/175; F21V 23/06; H01R 12/721; H01R 13/2442; F21Y 2103/003; F21Y 2101/02

USPC ..... 362/218, 217.17; 439/76.2, 56, 620.22, 439/620.15, 620.16

See application file for complete search history.

(56) References Cited

U.S. PATENT DOCUMENTS

| | | | | |
|---|---|---|---|---|
| 4,558,912 | A * | 12/1985 | Coller et al. | 439/246 |
| 6,193,385 | B1 * | 2/2001 | Maki et al. | 362/108 |
| 6,520,779 | B1 * | 2/2003 | Watanabe et al. | 439/66 |
| 7,997,770 | B1 * | 8/2011 | Meurer | 362/311.02 |
| 2009/0046457 | A1 * | 2/2009 | Everhart | 362/235 |
| 2010/0046223 | A1 * | 2/2010 | Li et al. | 362/249.02 |
| 2010/0201239 | A1 * | 8/2010 | Mostoller | F21K 9/175 313/1 |
| 2011/0117786 | A1 * | 5/2011 | Takata | 439/628 |
| 2011/0228517 | A1 * | 9/2011 | Kawabat et al. | 362/84 |

FOREIGN PATENT DOCUMENTS

| | | | |
|---|---|---|---|
| JP | 2011-060428 | A | 3/2011 |
| JP | 2011-165528 | A | 8/2011 |
| JP | 2012-069296 | A | 4/2012 |
| KR | 10-0949699 | B1 | 3/2010 |
| KR | 10-2011-0093540 | A | 8/2011 |

(Continued)

*Primary Examiner* — Jason Moon Han
*Assistant Examiner* — Omar Rojas Cadima
(74) *Attorney, Agent, or Firm* — Rabin & Berdo, P.C.

(57) ABSTRACT

The light emitting diode lighting apparatus includes: a tubular cover; a cap portion which is coupled to an end of a longitudinal direction of the cover; and a light emitting diode module which is coupled to the cap portion and is disposed within the cover. The cap portion includes: a cap which is coupled with the cover and is provided with a coupling portion therein; and a contact terminal which is coupled to the coupling portion to directly contact the light emitting diode module and elastically supports the light emitting diode module.

2 Claims, 5 Drawing Sheets

(56) References Cited

FOREIGN PATENT DOCUMENTS

| | | | |
|---|---|---|---|
| KR | 10-1062252 | B1 | 9/2011 |
| KR | 10-2011-0131908 | A | 12/2011 |
| KR | 20-2011-0012044 | U | 12/2011 |
| WO | WO 2009-154162 | A1 | 12/2009 |

* cited by examiner

LED LIGHTING APPARATUS

CROSS-REFERENCE TO RELATED APPLICATION

This application claims priority to and the benefit of Korean Patent Application No. 10-2012-0048699 filed in the Korean Intellectual Property Office on May 8, 2012, the entire contents of which are incorporated herein by reference.

FIELD OF THE INVENTION

The present invention relates to an LED lighting apparatus using a light emitting diode device.

BACKGROUND ART

An LED lighting apparatus is a lighting apparatus which is provided with an LED module inside a light transmitting cover and emits light by applied electrical power.

As the invention disclosed in Korean Utility Model publication No. 2011-0012044, in the prior art a printed circuit board of an LED module and pins through which outer electric power is applied are connected to one another by an electrical cable with a predetermined length. In more detail, in the prior art the LED lighting device in which a method of connecting the pins and the printed circuit board with an electrical cable, i.e., a method of connecting a terminal at the end of the electrical cable extended from the printed circuit board and contacting the terminal to the pin and coupling with a screw or a method of coupling the pin and the electrical cable through a process such as a welding is applied has been used.

However, the conventional LED lighting apparatus which adopts a method of the printed circuit board and the pin with the electrical cable has a problem in that a process of separating the electrical cable for the purpose of repair or replacement of parts is complicated or in case of being connected by welding the separation is not easy so as to deteriorate the workability so that it is difficult to repair or replace parts.

Technical Problem

The present invention has been made in an effort to provide a light emitting diode lighting apparatus which is not provided with an addition electrical wire for connecting the pin and the printed circuit board and the LED module and the cap can be easily separated and coupled.

Technical Solution

An exemplary light emitting diode lighting apparatus according to an embodiment of the present invention includes: a tubular cover; a cap portion which is coupled to an end of a longitudinal direction of the cover; and a light emitting diode module which is coupled to the cap portion and is disposed within the cover. The cap portion includes: a cap which is coupled with the cover and is provided with a coupling portion therein; and a contact terminal which is coupled to the coupling portion to directly contact the light emitting diode module and elastically supports the light emitting diode module.

The coupling portion may include a first protrusion protruding in a longitudinal direction from an inner end portion of the cap and a second protrusion protruding in a longitudinal direction at a lower end of the first protrusion, such that the contact terminal can be fitted in a longitudinal direction to be coupled.

A pin coupling hole which is perforated in a longitudinal direction of the cap may be formed at the coupling portion.

The cap may further include: an enclosing portion which covers one side of the cover; an insert hole into which the light emitting diode module is inserted; and a support member which is formed at a position apart from a lower end of the coupling portion by a predetermined distance so as to form the insert hole.

A hooking hole for the coupling with the cap may be formed at one side of the cover, and a hooking protrusion may be formed at the enclosing portion at a position corresponding to the hooking hole.

A separation prevention member may be provided to the enclosing portion.

The contact terminal may include: a first contact portion which is formed in a shape corresponding to the first protrusion and is coupled with the first protrusion; a second contact portion which is extended from the first contact portion to have a shape corresponding to the second protrusion and is coupled with the second protrusion; and a third contact portion which is extended from the second contact portion and contacts the light emitting diode module.

A pin insert hole may be formed to the first contact portion.

The contact terminal may be provided in a plurality.

The cap portion may further include a pin which is disposed to penetrate the cap and is supplied with electricity.

The coupling portion and the pin may be respectively provided in a plurality.

The light emitting diode module may include a plurality of light emitting diode devices and a light emitting diode module printed circuit board having a rod shape, and the light emitting diode devices may be disposed on the light emitting diode printed circuit board so as to be arranged in a line along a longitudinal direction of the rod shape.

The cover may include: a diffusion cover which covers the plurality of the light emitting diode devices so as to diffuse light emitted from the plurality of the light emitting diode devices; and a heat radiation plate which covers a lower surface of the light emitting diode printed circuit board so as to radiate heat of the light emitting diode printed circuit board.

The diffusion cover and the heat radiation plate may be formed to form a hollow cylinder shape by being connected with one another.

The heat radiation plate may include: outer grooves which are respectively formed at both outer sides along a longitudinal direction of the hollow cylinder shape so as to be connectable with the diffusion cover; and inner grooves which are respectively formed at both inner sides along a longitudinal direction of the hollow cylinder shape so as to be connectable with the light emitting diode printed circuit board.

The diffusion cover may be made of polycarbonate resin of a diffusing type or glass material of a diffusing type.

The heat radiation plate may be formed by double injection molding using ABS, PPS or PPA.

Advantageous Effects

According to the present invention, since the contact terminal connected to the pin to which electricity is supplied directly contacts the LED module, an addition electrical wire for supplying electricity to the LED module is not necessary, and thereby a process for connecting the electrical wire to the LED module and the pin is not needed so that the workability can be enhanced.

Further, since the contact terminal is provided to the cap, it can be easily separated from and coupled to the cover and the LED module, and thereby repair and substation of parts can be easy so that the product credibility can be enhanced.

Further, since the contact terminal is provided with the third contact portion, the contact terminal can directly contact the LED module through the third contact portion when the LED module is inserted into the insert hole and at the same time the third contact portion elastically supports the LED module by its elastic force toward the support member so as to fix the LED module so that contact failure due to external influences such as vibration can be prevented.

DETAILED DESCRIPTION OF THE EMBODIMENTS

Embodiments of the present invention will be described hereinafter with reference to the accompanied drawings.

Figure 1:
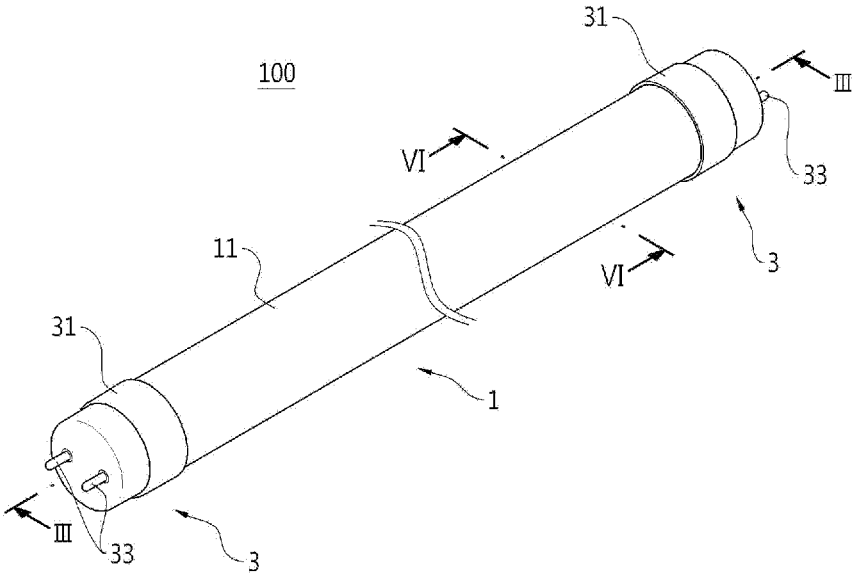
FIG. 1 is a perspective view of an LED lighting apparatus according to an embodiment of the present invention.
Figure 2:
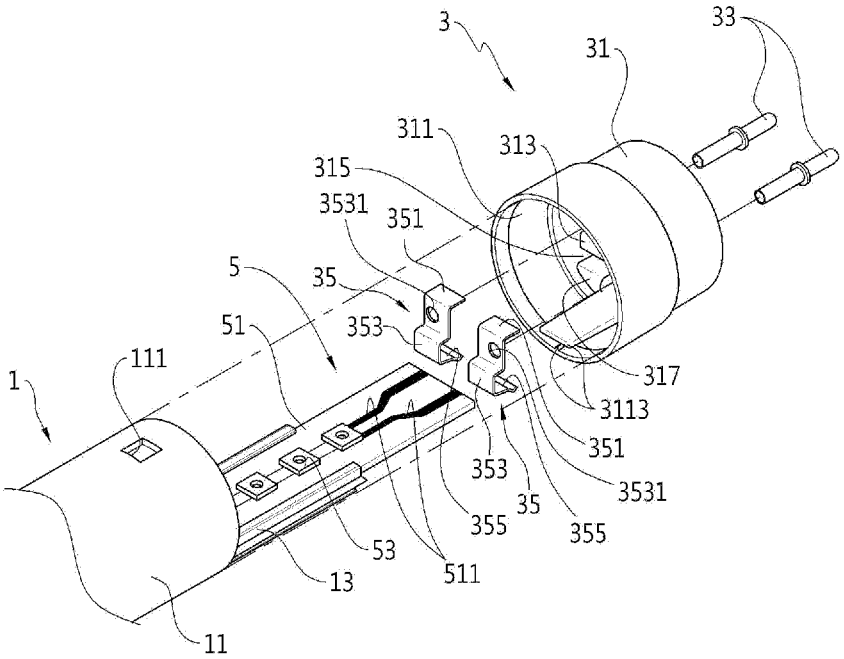
FIG. 2 is a partially exploded perspective view of an LED lighting apparatus according to an embodiment of the present invention.
Figure 3:
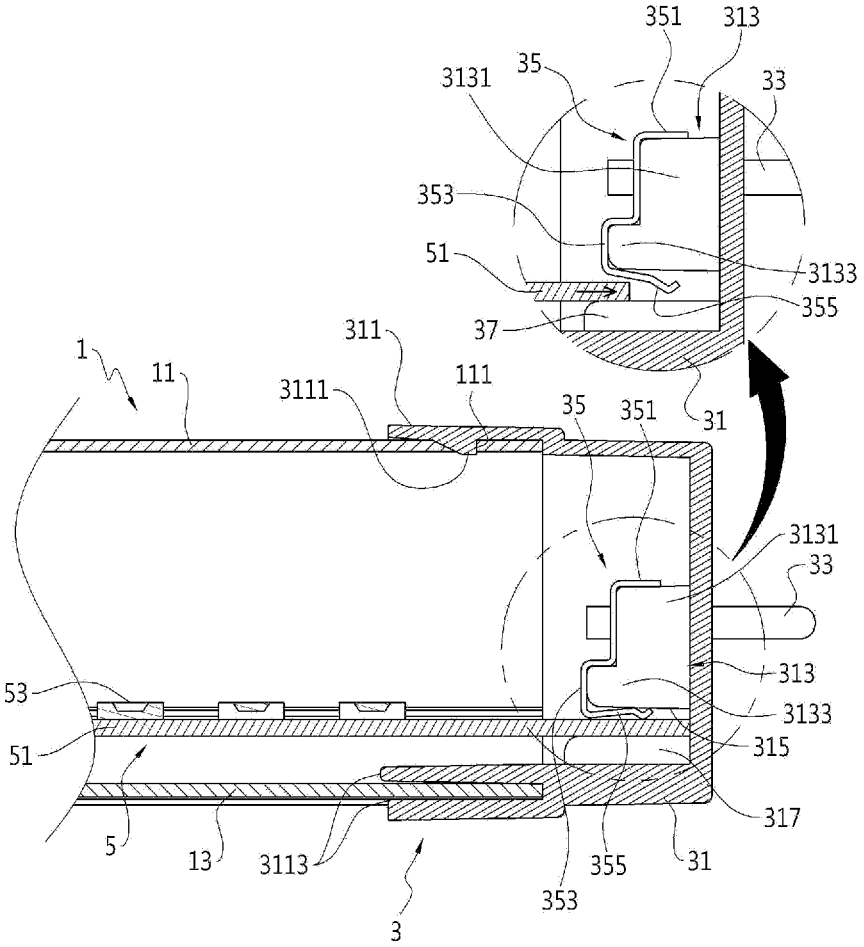
FIG. 3 is a sectional view taken along a line III-III in FIG. 1.
Figure 4:
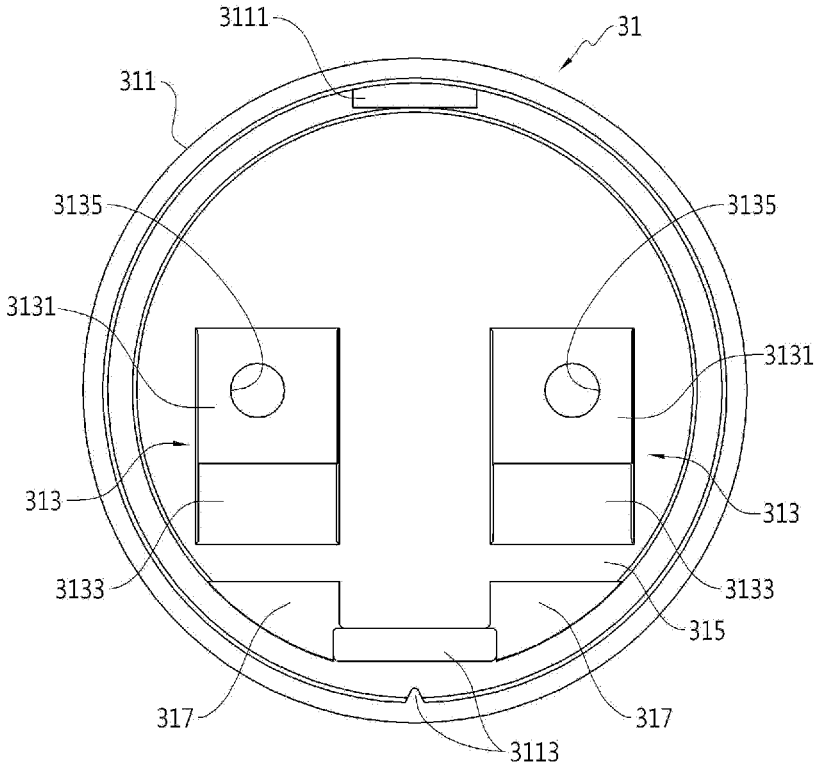
FIG. 4 is a top view showing an internal structure of a cap of an LED lighting apparatus according to an embodiment of the present invention.
Figure 5:
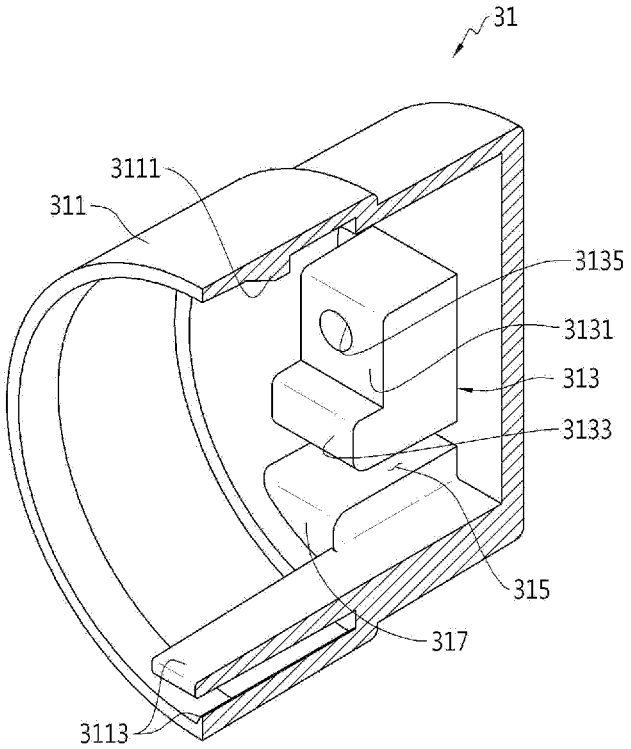
FIG. 5 is a cut away perspective view showing an internal structure of a cap of an LED lighting apparatus according to an embodiment of the present invention.
Figure 6:
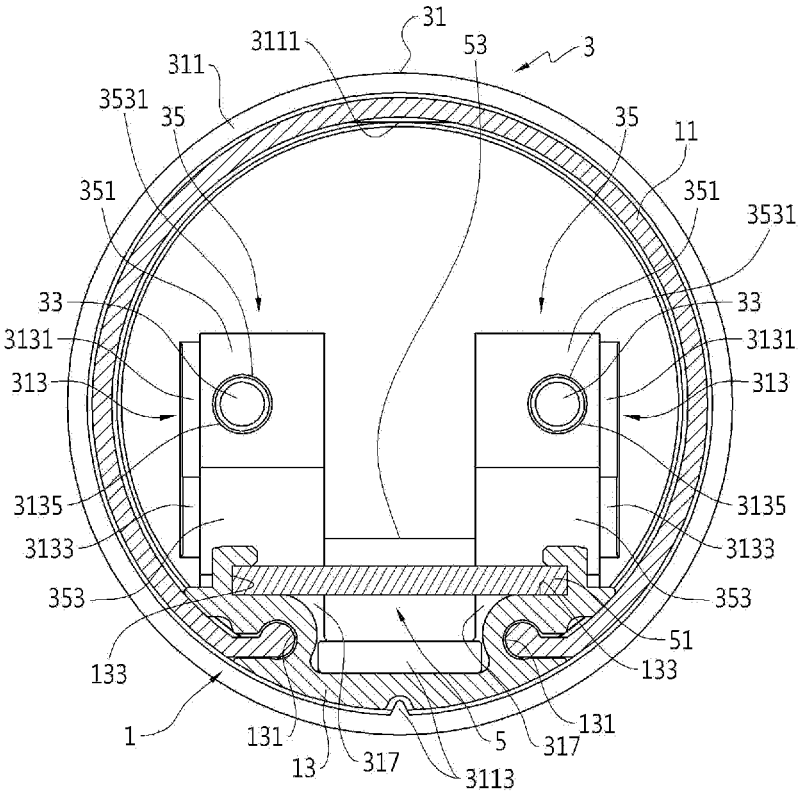
FIG. 6 is a sectional view taken along a line VI-VI in FIG. 1.

FIG. 1 is a perspective view of an LED lighting apparatus according to an embodiment of the present invention, FIG. 2 is a partially exploded perspective view of an LED lighting apparatus according to an embodiment of the present invention, FIG. 3 is a sectional view taken along a line III-III in FIG. 1, FIG. 4 is a top view showing an internal structure of a cap of an LED lighting apparatus according to an embodiment of the present invention, FIG. 5 is a cut away perspective view showing an internal structure of a cap of an LED lighting apparatus according to an embodiment of the present invention, and FIG. 6 is a sectional view taken along a line VI-VI in FIG. 1.

Referring to FIG. 1 and FIG. 2, an LED lighting apparatus 100 according to an embodiment of the present invention (hereinafter referred to as an LED lighting apparatus 100) includes a cover 1, a cap portion 3 and a light emitting diode module 5.

In more detail, the LED lighting apparatus 100 includes a tubular cover 1, a cap portion 3 which is coupled to a longitudinal end portion of the cover 1, and a light emitting diode module 5 including a light emitting diode (LED) printed circuit board (PCB) 51 which is connected to the cap portion 3 to be disposed within the cover 1 and a plurality of light emitting diode devices 53 which are arranged on an upper surface of the LED printed circuit board 51.

First the cap portion 3 will be described.

The cap portion 3 of the LED lighting apparatus 100 may include a cap 31 and a contact terminal 35.

In more detail, referring to FIGS. 2 and 3, the cap portion 3 of the LED lighting apparatus 100 may include the cap 31 which is coupled to an end portion of the cover 1 and is provided at an inside thereof with a coupling portion 313, and the contact terminal which is coupled to the coupling portion 313 to contact the LED module 5 and to elastically support the LED module 5 to fix the same.

The cap 31 will be described in detail.

Referring to FIG. 3 to FIG. 5, the cap 31 is provided with the coupling portion 313 at an inside thereof. In more detail, the coupling portion 313 may include a first protrusion 3131 protruding in a longitudinal direction from an inner end portion of the cap 31 and a second protrusion 3133 protruding in a longitudinal direction at a lower end of the first protrusion 3131, such that the contact terminal 35 can be fitted in a longitudinal direction to be coupled. At this time, the second protrusion 3133 may be formed to be protruded in a longitudinal direction more than the first protrusion 3131 so that the contact terminal 35 coupled to the coupling portion 313 can be prevented from being easily separated from the coupling portion 313. Here, the longitudinal direction means a horizontal direction in FIG. 3.

In addition, referring to FIG. 4 and FIG. 5, a pin coupling hole 3135 which is perforated in a longitudinal direction of the cap 31 may be formed at the coupling portion 313. Accordingly, a pin 33 which is described later is coupled into the pin coupling hole 3135 and the contact terminal 35 is coupled to the coupling portion 313 of the cap 31, so that the pin 33 and the contact terminal 35 can be connected to one another. Exemplarily, the pin coupling hole 3135 may be formed at the first protrusion 3131. However, this may be changed depending on the necessity in use.

In addition, the cap may further include an enclosing portion 311, an insert hole 315 and a support member 317.

In more detail, referring to FIG. 3 to FIG. 5, the cap 31 may include the enclosing portion 311 which covers one side of the cover 1, the insert hole 315 into which the LED module 5 is inserted, and the support member 317 which is formed at a position apart from the lower end of the coupling portion 313 by a predetermined distance so as to form the insert hole 315.

The enclosing portion 311 may be coupled to the cover 1 in a state of enclosing an end portion of the cover, i.e., the outer periphery of one side of the cover 1. For example, a hooking hole 111 for coupling with the cap 31 is formed at one side of the cover 1, and the hooking protrusion 3111 may be formed at the enclosing portion 311 at a position corresponding to the hooking hole 111 formed at one side of the cover 1. In addition, a separation prevention member 3113 may be formed at the enclosing portion 311. The separation prevention member 3113 can guide the cover 1 which has been coupled to the enclosing portion 311 and at the same time can prevent the cover 1 from being separated from the cap 31. However, the hooking hole 111, the structures and the shapes of the hooking protrusion 3111 and the separation prevention member 3113 can be varied depending on the necessity in use.

Then, the insert hole 315 and the support member 317 may be formed.

Referring to FIG. 3 to FIG. 5, the insert hole 315 into which the LED module 5 is inserted and the support member 317 which supports the LED module 5 may be formed inside the cap 31. In more detail, the insert hole 315 may be formed between the coupling portion 313 and the support member 317 which is formed at a position lower in a vertical direction than a lower end of the coupling portion 313 by a predetermined distance. That is, the support member 317 may be formed by being protruded in a longitudinal direction at an inner end of the cap at a position apart from the lower end of the coupling portion 313 by a predetermined distance so as to form the insert hole 315 therebetween. Accordingly, the LED module 5 can be inserted into a space between the coupling portion 313 and the support member 317, i.e., the insert hole 315.

The contact terminal 35 of the cap portion 3 will be described hereinafter.

Referring to FIG. 2 and FIG. 3, the contact terminal 35 may be formed in a shape corresponding to the coupling portion 313 and can be coupled to an end portion of the coupling portion 313.

In more detail, the contact terminal 35 may include a first contact portion 351 which is formed in a shape corresponding to the first protrusion 3131 of the coupling portion 313, a second contact portion 353 which is extended form a lower end of the first contact portion 351 to have a shape corresponding to the second protrusion 3133 of the coupling portion 313, and a third contact portion 355 which is extended from a lower end of the second contact portion 353 and is inserted into the insert hole 315. That is, the first contact portion 351, the second contact portion 353 and the third contact portion 355 of the contact terminal 35 may be formed integrally, and the first contact portion 351 may be coupled to the first protrusion 3131 of the coupling portion 313 and the second contact portion 353 may be coupled to the second protrusion 3133 of the coupling portion 313. At this time, the third contact portion 355 being extended from the second contact portion 353 may be formed in a shape of being widened to the outside when it goes toward an inner end of the cap 31 in a state that the LED module 5 is not inserted into the insert hole 315, i.e., in an initial state. Accordingly, while the LED module 5 is being inserted into the insert hole 315 of the cap 31, the LED module 5 is inserted while pushing the third contact portion 355 of the contact terminal, which is widened to the outside, toward the inside so that the third contact portion 355 and the LED module 5 may directly contact each other. In addition, the third contact portion 355 directly contacts the LED module 5 and at the same time elastically supports the LED module by its elastic force. Accordingly, the LED module 5 is pushed to contact the support member 317 to be fixed to the cap 31 without being separated from the insert hole 315.

A pin insert hole 3531 may be formed in the contact terminal 35.

In more detail, the pin insert hole 3531 into which a pin 33 is inserted may be formed at the first contact portion 351 of the contact terminal 35. For example, the pin inset hole 3531 may include a plurality of teeth at a surface thereof to fix the inserted pin 33. However, the structure and the shape of the pin insert hole 3531 may be altered depending on the necessity in use.

The contact terminal 35 may be provided in plural.

For example, the contact terminal 35 may be formed of copper alloy by a press forming to connect an anode and a cathode to the LED module 5 respectively. However, the base material and the forming method of the contact terminal 35 may be changed depending on the necessity in use.

Referring to FIG. 2 and FIG. 3, the cap portion 3 of the LED lighting apparatus 100 may further include the pin 33.

In more detail, the cap portion 3 may further include the pin 33 which is disposed to penetrate the cap 31 and to be applied with electricity from the outside.

For example, the pin 33 may be provided with plural having a shape of a rod and being arranged in parallel with each other, and the plural pins 33 respectively extend to be protruded to the outside of the cap 31 so as to be able to be connected to an external electric socket (not shown) and at the same time respectively penetrate the cap 31 and inwardly extend to be protruded to the inside of the cap 31 so as to be connected to the LED module 5. That is, the electricity may be applied to the LED module 5 from the electrical socket through the plural pins 33. Accordingly, the coupling portion 313 to which the pin coupling hole 3135 is provided and the pin 33 may be formed in plural. Further, the pin 33 may be formed to be integral with the cap 31 and may be formed by a press fitting or a swaging.

The LED module 5 of the LED lighting apparatus 100 will be described hereinafter.

The LED module 5 includes an LED printed circuit board (PCB) 51 which is connected to the cap portion 3 and is disposed within the cover 1, and a plurality of light emitting diode devices 53 which are disposed on an upper surface of the LED PCB.

The LED PCB 51 may have a shape of a rod, and the plurality of light emitting diode devices 53 may be arranged on the LED PCB 51 to be disposed in a line along a longitudinal direction of the rod shape. For example, the LED PCB 51 may fix the plurality of the light emitting diodes devices 53 and may apply electricity to the same.

In addition, the LED module 5 may be provided with elements for converting electricity to a form suitable for being supplied to the LED PCB 51. For example, the LED module 5 may include a convert (not shown) for converting alternating current to direct current and supplying the converted direct current to the LED PCB 51.

A circuit contact portion 511 which contacts the third contact portion 355 of the contact terminal 35 may be formed on the LED PCB 51, and the circuit contact portion 511 may be divided into an anode and a cathode. For example, the circuit contact portion 511 may be electrodes of a circuit which are formed by being printed.

In addition, the LED lighting apparatus 100 may include a tubular cover 1.

Referring to FIG. 6, the cover 1 may include a diffusion cover 11 which covers the plurality of the LED devices 53 so as to diffuse light emitted from the plurality of the LED devices 53, and a heat radiation plate 13 which covers a lower surface of the LED PCB 51 so as to radiate heat of the LED PCB 51.

For example, the diffusion cover 11 may have a sectional shape of a semicircle and may cover the LED devices 53 in a type of a tubular shape a lower side of which is open. In addition, the heat radiation plate 13 may also have a section shape of a semicircle and may cover a lower surface of the LED PCB 51 in a type of a tubular shape an upper side of which is open.

In addition, as shown in FIG. 6, the diffusion cover 11 and the heat radiation plate 13 may be formed to form a shape of a hollow cylinder by being connected to one another.

The heat radiation plate 13 may include outer grooves 131 which have a hollow cylindrical shape and are formed at both outer sides thereof so as to be connected with the diffusion cover 11, and inner grooves 133 which have a hollow cylindrical shape and are formed at both inner sides thereof so as to be connected with the LED PCB 51.

That is, lower ends of the diffusion cover 11 may be coupled to the outer grooves 131 of the heat radiation plate 13 by being fitted thereinto.

In addition, a portion of the LED PCB 51 may be fitted into the inner grooves 133 of the heat radiation plate 13. For example, both sides of the LED PCB 51 having a rod shape may be fitted into the both inner grooves 133 of the heat radiation plate 13. However, this coupling method is only an example, and the coupling may be realized according to the structure of the LED PCB 51.

Meanwhile, the diffusion cover 11 may be formed of material for diffusing light emitted from the LED device 53 in a forward direction. For example, the diffusion cover 11 may be formed of synthetic resin such as polycarbonate resin of a diffusing type, and may be formed of thermosetting resin or glass material of a diffusing type according to the necessity in use.

Further, the heat radiation plate 13 may be made of aluminum (Al). Accordingly, the heat may be radiated effectively and at the same time the weight may be reduced. By the reduction of weight, an effect of preventing a safety accident which may be caused by the deformation of the fixing part by weight and the drop of some parts can be achieved. Alternatively, the heat radiation plate 13 may be formed by a double injection molding using material such as ABS(Acrylonitrile/Butadien/Styrene), PPS(Poly Phenylene Sulfide), and PPA(Poly Phthal Amide). That is, the heat radiation plate 13 may increase the bending rigidity of the diffusion cover 11 by being coupled with the same, and the heat radiation plate 13 may be formed by a double injection molding using material such as ABS, PPS and PPA which are different from the diffusion cover 11. By a double injection molding, characteristics such as a thermal resistance can be enhanced.

As such, in the LED lighting apparatus 100 the contact terminal 35 which is connected to the pin 33 through which the electricity is supplied from the outside is formed to directly contact the LED module 5, so an additional electrical wire for supplying electricity to the LED module 5 is not required, and thus a process for connecting an electrical wire to the LED module 5 and the pin 33 can be omitted so that the workability can be enhanced.

Further, since the contact terminal 35 is provided to the cap 31, it can be easily separated from and coupled to the cover 1 and the LED module 5, and thereby repair and substation of parts can be easy so that the product credibility can be enhanced.

Further, since the contact terminal 35 is provided with the third contact portion 355, the contact terminal 35 can directly contact the LED module 5 through the third contact portion 355 when the LED module 5 is inserted into the insert hole 315 and at the same time the third contact portion 355 elastically supports the LED module 5 by its elastic force toward the support member 317 so as to fix the LED module 5 so that contact failure due to external influences such as vibration can be prevented.

While this invention has been described in connection with what is presently considered to be practical exemplary embodiments, it is to be understood that the invention is not limited to the disclosed embodiments, but, on the contrary, is intended to cover various modifications and equivalent arrangements included within the spirit and scope of the appended claims.

What is claimed is:

1. A light emitting diode lighting apparatus, comprising:

a tubular cover having a hooking hole formed at one side of the tubular cover;

a cap portion which is coupled to a longitudinal end of the tubular cover; and a light emitting diode module which is coupled to the cap portion and is disposed within the tubular cover, the light emitting diode module including a substrate, wherein the cap portion comprises:

a cap which is coupled with the tubular cover and is provided with a coupling portion therein, the cap having an enclosing portion which is connected to one end of the tubular cover and including a support member disposed below the coupling portion and being spaced therefrom, the cap further having a hooking protrusion formed at the enclosing portion at a position corresponding to the hooking hole, the enclosing portion comprising an encloser which encloses an outer surface of one end of the tubular cover, and an inner supporting member which extends in a longitudinal direction of the tubular cover in a state of being spaced from an inner surface of the encloser, one end of the tubular cover being fitted between the encloser and the inner supporting member, a contact terminal which is coupled to the coupling portion to directly contact the light emitting diode module and elastically supports the light emitting diode module, and a pin which is a separate feature from the contact terminal, wherein the substrate of the light emitting diode module is inserted between the coupling portion and the support member so that the substrate contacts the contact terminal in a state of being pressed by the support member, and wherein positions of the encloser and the inner supporting member and positions of the hooking hole and the hooking protrusion are arranged such that the hooking protrusion is coupled to the hooking hole after the tubular cover has been inserted into a space between the encloser and the inner supporting member.

2. The light emitting diode lighting apparatus of claim 1, wherein the coupling portion comprises:

a first protrusion protruding in a longitudinal direction of the tubular cover from an inner end portion of the cap; and a second protrusion protruding in the longitudinal direction at a lower end of the first protrusion, wherein the contact terminal comprises:

a first contact portion which is formed in a shape corresponding to the first protrusion and is coupled to the first protrusion in a state of pressing an upper surface of the first protrusion;

a second contact portion which is extended from the first contact portion to have a shape corresponding to the second protrusion and is coupled with the second protrusion; and a third contact portion which is extended from the second contact portion and contacts the light emitting diode module in a state of pressing a lower surface of the second protrusion, and wherein the substrate of the light emitting diode module is inserted between the coupling portion and the support member to deform a shape of the third contact portion so that the substrate contacts the contact terminal in a state of being pressed by the third contact portion.

* * * * *